US006041566A

United States Patent [19]

Allen

[11] Patent Number: 6,041,566

[45] **Date of Patent: *Mar. 28, 2000**

[54] COMPOSITE WALL SYSTEM

[75] Inventor: Joseph Allen, Clarkston, Wash.

[73] Assignee: Bale Built, Inc., Lewiston, Id.

[ * ] Notice: This patent is subject to a terminal disclaimer.

[21] Appl. No.: 09/069,895

[22] Filed: Apr. 29, 1998

Related U.S. Application Data

[63] Continuation-in-part of application No. 08/715,994, Sep. 19, 1996, Pat. No. 5,749,199.

[51] Int. Cl.[7] ..... E04C 3/36

[52] U.S. Cl. ..... 52/729.1; 52/729.2; 52/DIG. 9

[58] Field of Search ..... 52/639, 690, 729.1, 52/729.2, 729.3, 729.4, 729.5, DIG. 9

[56] References Cited

U.S. PATENT DOCUMENTS

| | | |
|---|---|---|
| 225,065 | 3/1880 | Leeds . |
| 312,375 | 2/1885 | Orr . |
| 2,202,850 | 6/1940 | Guigon . |
| 2,372,200 | 3/1945 | Hayes . |
| 2,490,537 | 12/1949 | Myer . |
| 3,824,754 | 7/1974 | Fatosme et al. . |
| 4,034,529 | 7/1977 | Lampus . |
| 4,074,498 | 2/1978 | Keller et al. . |
| 4,397,128 | 8/1983 | Wolde-Tinsae . |
| 4,602,461 | 7/1986 | Cummins et al. . |
| 5,285,616 | 2/1994 | Tripp . |
| 5,398,472 | 3/1995 | Eicheldraut . |
| 5,412,921 | 5/1995 | Tripp . |

FOREIGN PATENT DOCUMENTS

| | | |
|---|---|---|
| 1027281 | 5/1953 | France . |
| 2426780 | 12/1979 | France . |
| 2917551 | 11/1979 | Germany . |
| 348535 | 10/1960 | Switzerland . |
| 406053 | 8/1932 | United Kingdom . |

*Primary Examiner*—Beth A. Aubrey
*Attorney, Agent, or Firm*—Ormiston Korfanta & Holland, PLLC

[57] ABSTRACT

A composite wall system that uses fiber bales or other quasi-structural building blocks in conjunction with a bracing system that stabilizes vertical rods to create columns capable of transferring the gravity compressive loads on the wall to the foundation. Rod columns are installed vertically along a line between the inside and outside faces of the wall. The rods extend from a foundation at the bottom end to a header at the top end. The rods are operatively connected to trusses or beams integrated into the layers of bales. The trusses or beams braces and thereby immobilizes the rods in all horizontal directions at every bale interface.

46 Claims, 8 Drawing Sheets

COMPOSITE WALL SYSTEM

CROSS REFERENCE TO RELATED APPLICATIONS

This is a continuation-in-part of application Ser. No. 08/715,994 filed Sep. 19, 1996 now U.S. Pat. No. 5,749,199, entitled Fiber Bale Composite Structural Building System.

FIELD OF THE INVENTION

The invention relates generally to structural building systems and, more particularly, to a composite wall system that utilizes a skeletal framework in conjunction with fiber bales and other quasi-structural stabilizing media to form walls.

BACKGROUND OF THE INVENTION

A major structural component in the construction of many buildings is the bearing wall. This is the structure that transfers the vertical acting gravity induced loads generated from roofs and above grade floors to the building foundation. To perform this function acceptably, the wall must neither buckle nor deform vertically to any appreciable degree. The vertical structural elements in the bearing wall, which carry vertical compressive loads, are columnar in nature. These structural elements may be continuous, repetitive and linked, as in diaphragm type structures like reinforced concrete, brick and concrete block, or they may be spaced and discrete as in wood stud, steel stud or timber post type structures From an economic standpoint, it would be attractive to use baled straw to construct bearing walls. Straw is an inexpensive and readily available renewable resource. Historically, straw has been used in building materials as a binder. Straw bales have been used in building construction as non-structural envelopment components to provide form and thermal and sound insulation. Straw bales have not been widely used in engineered construction primarily because the bales have inherent structural limitations. The basic factor hindering the use of baled straw in construction is its low modulus of elasticity (that is, a flat stress versus strain curve). Considerable deformation has to take place to mobilize the compressive strength of a straw bale. This means that baled straw is not a viable option as a primary structural load bearing element. A wall constructed solely of straw bales performs poorly as a bearing wall because of excessive vertical deformation. This deficiency can be overcome by the insertion of an engineered skeletal framework in the bale matrix. The skeletal framework effectively converts the nature of the bale wall from a linked column type wall structure to a discrete and spaced column type wall structure.

SUMMARY OF THE INVENTION

The present invention is directed to a composite wall system that uses fiber bales or other quasi-structural building blocks in conjunction with a bracing system that stabilizes vertical rods to create columns capable of transferring the gravity compressive loads on the wall to the foundation. From a structural design standpoint, a wall height rod column with virtually no compressive load capacity is converted to a bale height rod column with considerable load capacity.

Baled straw and other quasi-structural media typically possess sufficient usable shear capacity to stabilize the rods and other direct stress carrying elements of a framework that is integrated into a matrix of stacked bales. Stacked bales, which are a desirable component of the structural system due to their insulating qualities, provide a spatial containment medium allowing the use of integral beams or trusses and rods to perform dual functions—the load carrying capacity of the structure with minimum distortion and the attachment framework for the finished wall. The bales are stacked vertically to form wall systems. The bales can be engineered as to size, shape, density and/or moisture content, as necessary, to achieve the desired structural characteristics.

At an elemental level, rod columns are installed vertically along a line between the inside and outside faces of the wall. The rods extend from a foundation at the bottom end to a beam type loading structure at the top end. The rods are one of the basic components used to construct the load bearing walls embodying the invention. The rods are operatively connected to trusses or beams integrated into the layers of bales. The trusses or beams do not allow the rod intersection point with the horizontal plane described by the bale interface to change position as the rod column is loaded through the range of values from zero load to the buckling load of the rod column. In other words, the rod is immobilized in all horizontal directions at every bale layer interface by the horizontal trusses or beams.

In one embodiment of the invention, bales or other quasi-structurally building blocks are stacked vertically in a staggered "running bond" configuration to form a bearing wall. In the skeletal framework for the wall, the vertical rods are positioned along the bales, preferably along the centerline of the bales for this embodiment. Trusses are formed at the interface between layers of bales. In one version of this embodiment, the trusses are formed by a pair of trussing members operatively connected to the bales. The trussing members are positioned opposite each other along the edges of the bales at the bale layer interfaces. The trussing members are operatively connected to the bales through, for example, a series of tooth like projections that penetrate the bales. The rods are stabilized by the lateral bending resistance of the truss in the direction perpendicular to the plane of the wall and by mobilization of the bale shear resistance in the plane of the wall.

In an alternative version of this embodiment, the trusses are formed by adding struts and cross ties which connect at their ends to the trussing members at panel points defined by the position of the vertical rod columns along the wall. The rods pass through a hole in the struts to supply the operative tie to the truss. It is desirable in this version of the truss to also make the operative connection between the trussing members and the bales to utilize the shear capacity of the bales to help stabilize the rods.

In a second embodiment, bales or other quasi-structurally building blocks are stacked vertically in a "stack bond" configuration to form a bearing wall. In the skeletal framework for this embodiment of the wall, the vertical rods are, preferably, positioned along the sides of the layered bales. Beams are placed along the edge of the bales at the horizontal interfaces between the layers of bales. The rods pass through holes in the webs of the beams. The rods are stabilized by the bending strength of the beams perpendicular to the plane of the wall. Preferably, the beams are operatively connected to the bales by sandwiching one beam flange in the bale interface or through some other shear transfer mechanism to utilize the shear capacity of the bales to help stabilize the rods. The rods will be stabilized in the plane of the wall by horizontal ties provided by the beams to appropriate structural elements at building corners or other beam termination points.

While it is expected that the invention will most often be embodied in fiber bale wall systems, other such quasi-structural building blocks could also be used. For example, it is expected that polystyrene blocks and similar types of expanded rigid plastic materials could be used. Presently, grain straw is one of the most inexpensive and readily available sources of fiber for baling. It is to be understood, however, that "bales", "fiber bales", or "straw bales" as those terms are used in this specification and in the claims refer broadly to straw, hay, wood fiber, shredded paper or any other material that is pressed or bundled into bales or similar such rectangular block type building units. Other three dimensional rectilinear forms of baled material or quasi-structural building blocks could also be used.

DETAILED DESCRIPTION OF THE INVENTION

Figure 1:
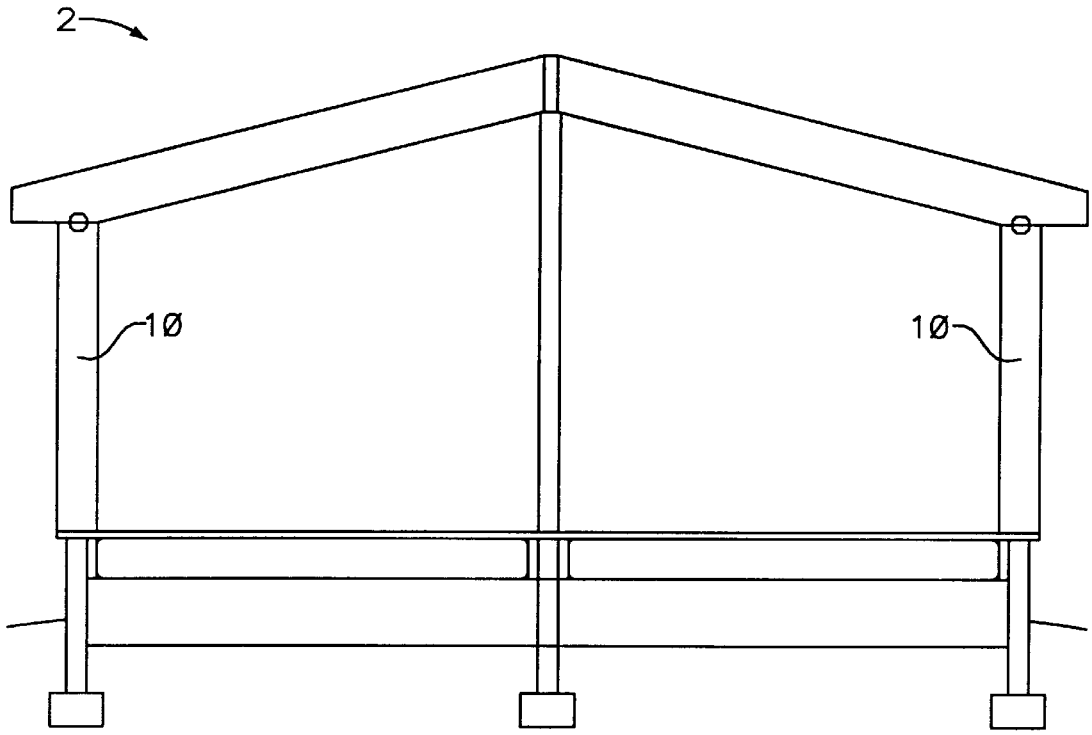
FIG. 1 is a representational elevation view of a building constructed using the wall system of the present invention.

FIG. 1 illustrates a typical residential or commercial building, designated generally by reference number 2, into which the various embodiments of the invention described below might be incorporated. The walls of building 2 are constructed according to the wall system 10, shown in detail in FIGS. 2–10. The invention, however, is not limited to the embodiments described herein. The invention provides a recipe for the fabrication of composite wall systems for use in buildings, as free standing wall systems such as fences or sound barriers, or any other structure where the use of fiber bales or other quasi-structural stabilizing blocks is desired.

Figure 2:
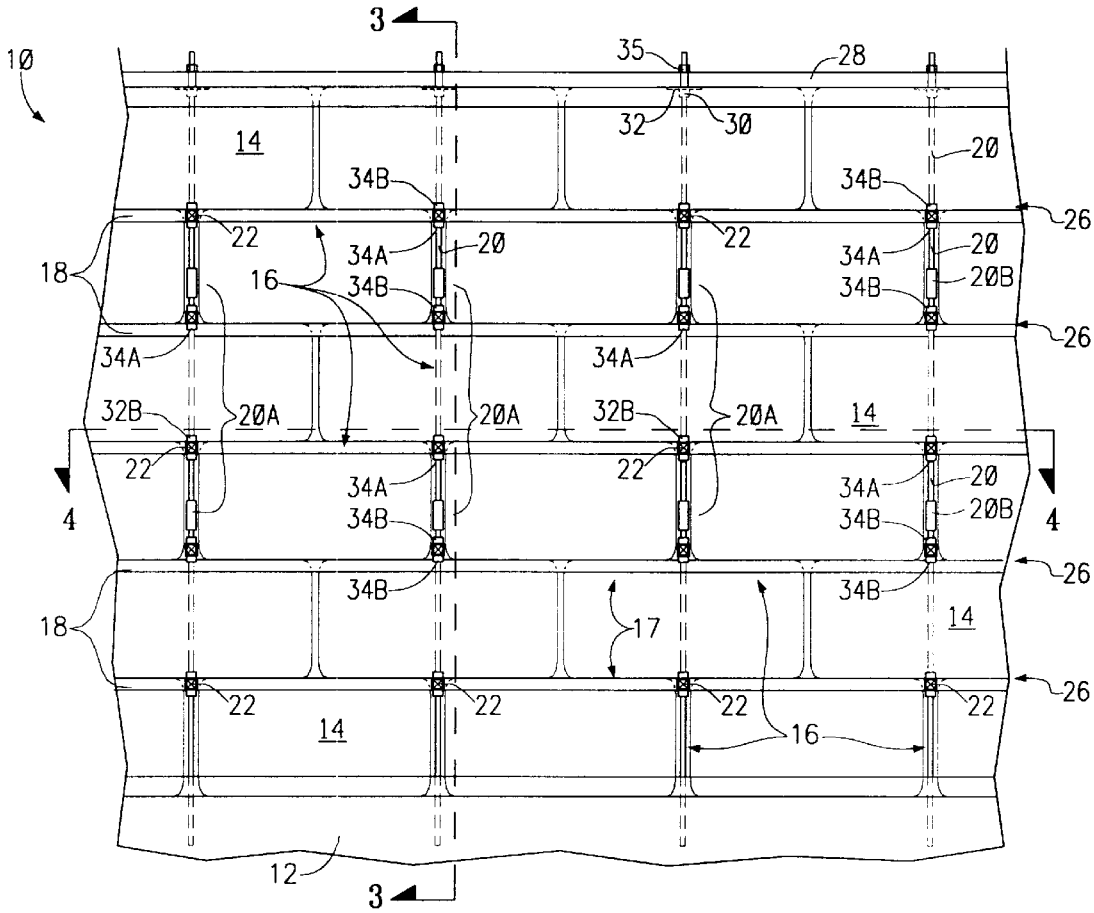
FIG. 2 is an elevation view showing a typical section of a wall constructed according one embodiment of the invention in which trusses are used to stabilize the rods.
Figure 3:
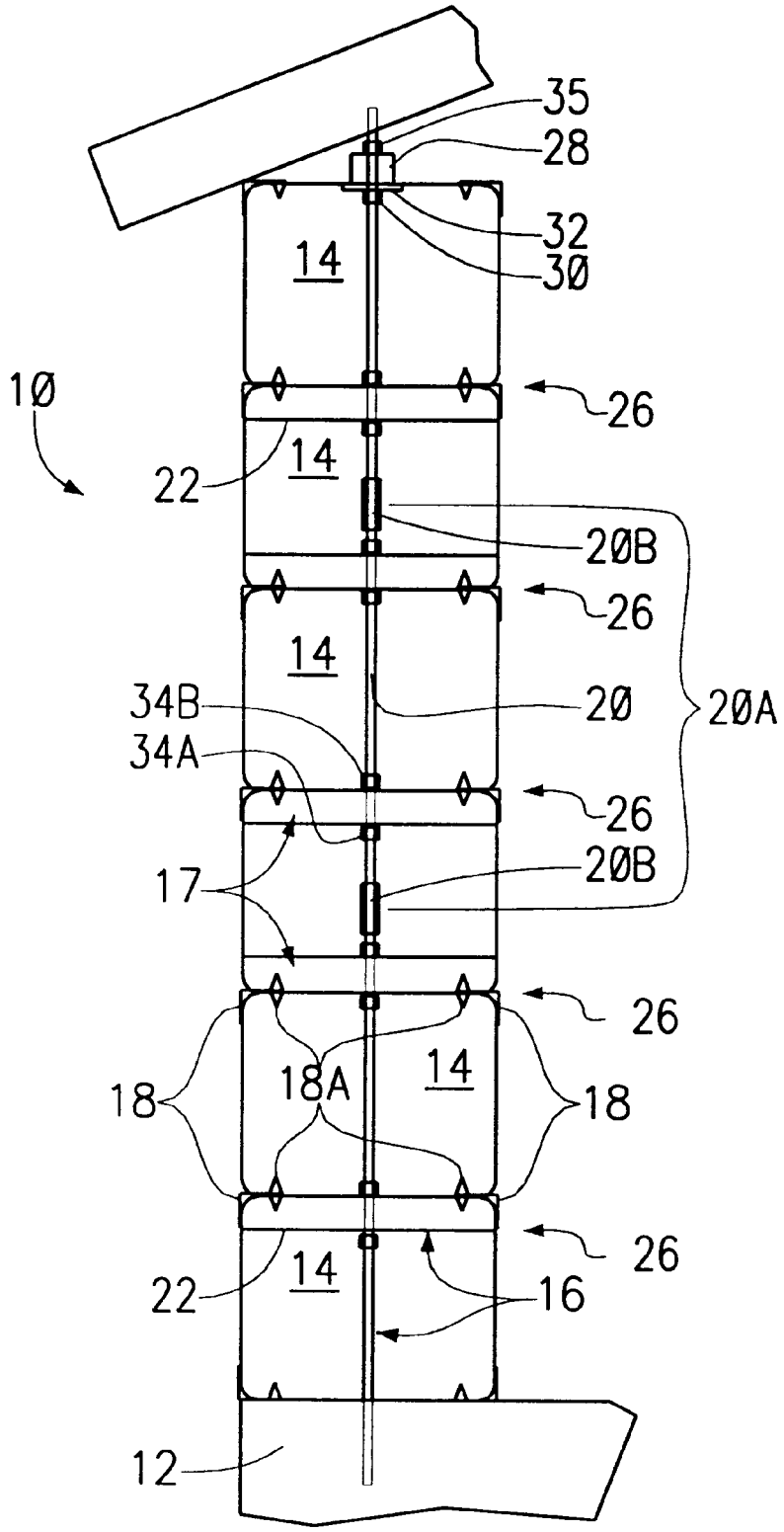
FIG. 3 is a cross section view of the wall of FIG. 2 taken along the line 3—3 in FIG. 2.
Figure 4:
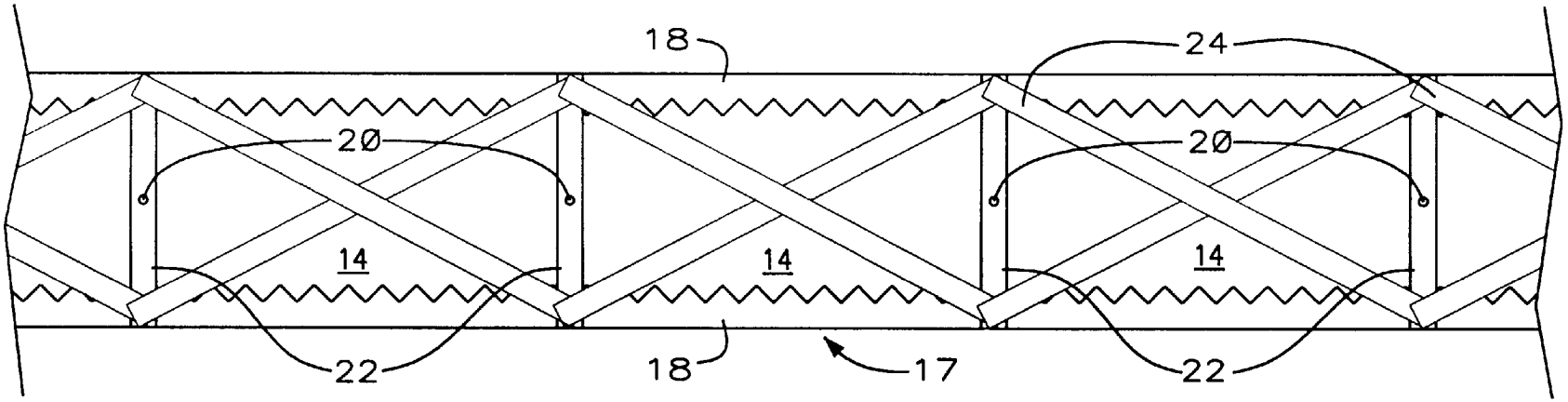
FIG. 4 is a cross section view of the wall of FIG. 2 taken along the line 4—4 in FIG. 2.
Figure 5:
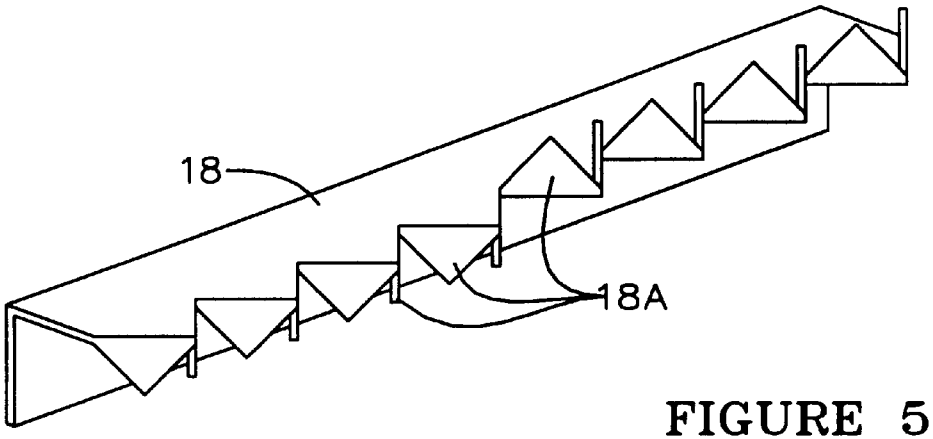
FIG. 5 is a detail perspective view of a toothed trussing member.

A bearing wall system in which trusses are used to brace the rod columns is shown in FIGS. 2–4. Referring to FIGS. 2–4, a bearing wall system 10 is shown constructed on a foundation 12. Bearing wall system 10 is also referred to herein as wall system 10 or simply as wall 10. Foundation 12 represents a conventional building foundation such as might be used in a typical residential or commercial building. Wall 10 is assembled by stacking bales 14 lengthwise in a staggered configuration, that is in "running bond," simultaneously with the erection of a skeletal framework 16. Alternatively, bales 14 may be stacked in a non-staggered configuration, that is in "stack bond." Running bond is preferred over stack bond in this embodiment due to the increased stability afforded by the running bond configuration.

Skeletal framework 16 includes a series of horizontal trusses 17 and vertical rods 20. Vertical rods 20 are anchored in foundation 12 along the center line of wall 10. Vertical rods 20 will usually be spaced apart the nominal length of a bale, typically about forty eight inches. The spacing of vertical rods 20 may be varied as necessary to achieve the desired performance characteristics for wall 10. Preferably, rods 20 are constructed as steel rods having a circular cross section. As with the other components of skeletal framework 16, however, any structurally stable materials and cross sectional shapes may be used. Rods 20 may be threaded to facilitate the integration of the struts and cross ties discussed below. For construction of an eight foot high wall, vertical rods 20 will normally comprise three, thirty six inch long threaded rod segments 20*a*. Rod segments 20*a* are spliced together with coupling nuts 20*b* to form rods 20. Rods 20 are segmented to allow the bales to be stacked without lifting alternate rows of bales, which are impaled on the rods, to the full wall height. Using segmented rods also facilitates the installation of other components of skeletal framework 16. Each vertical rod 20 may, however, be formed as a single continuous rod. Rods 20 are sized as necessary to safely support the anticipated loads for any particular wall system.

Figure 6:
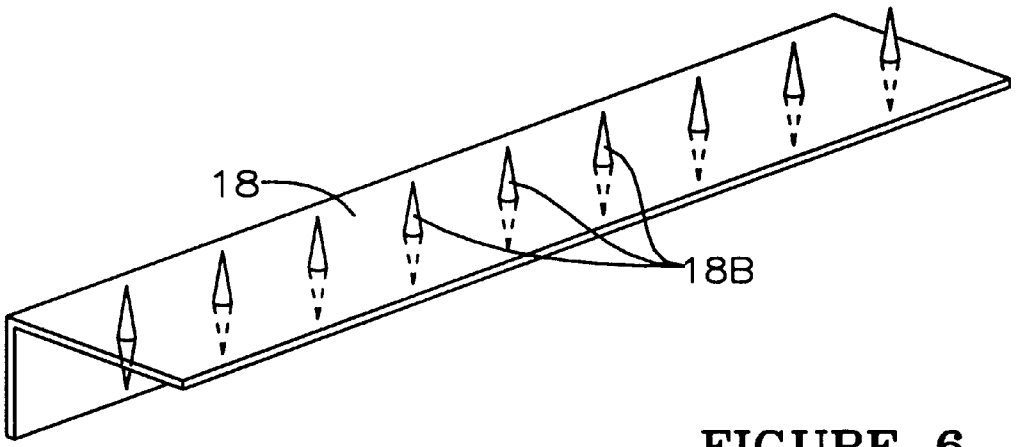
FIG. 6 is a detail perspective view of a studded trussing member.
Figure 7:
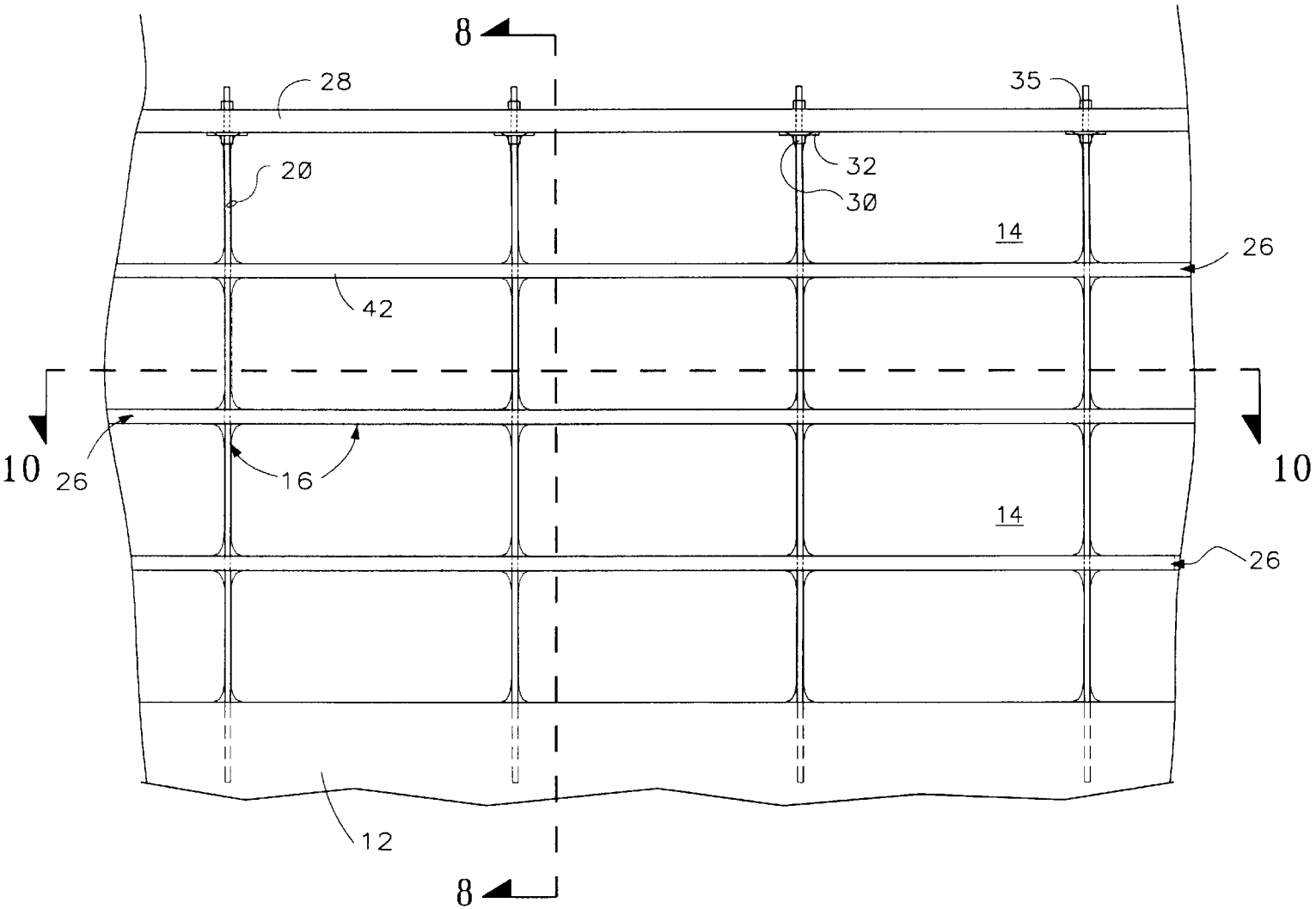
FIG. 7 is an elevation view showing a typical section of a wall constructed according to a second embodiment of the invention in which beams are used to stabilize the rods.
Figure 8:
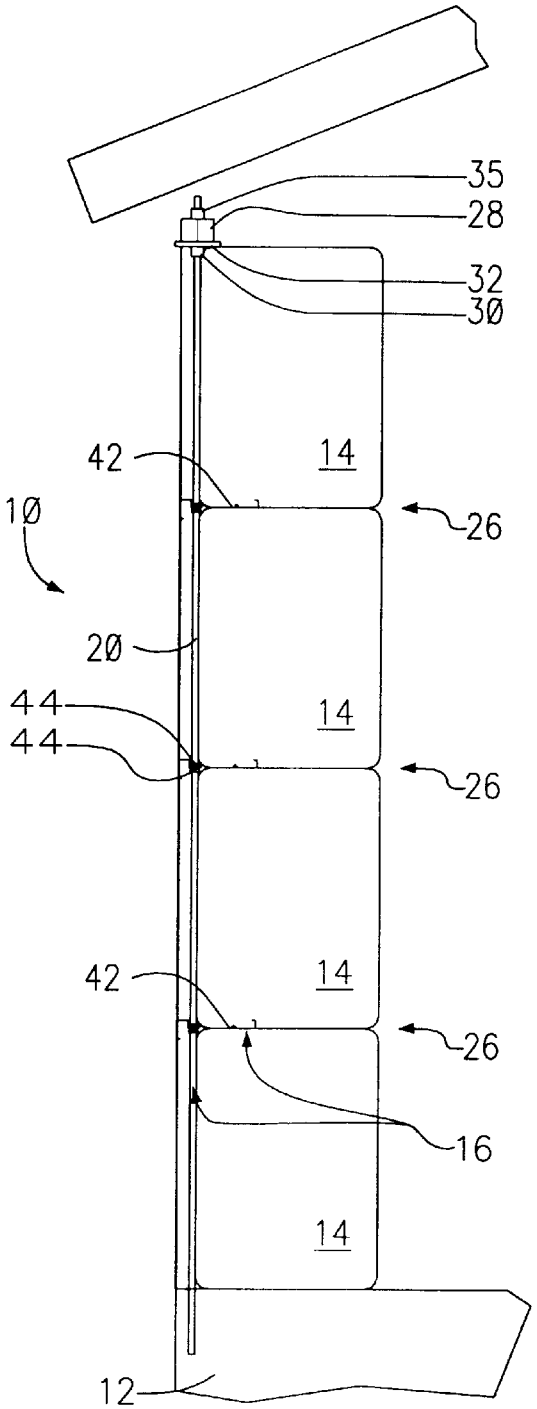
FIG. 8 is a cross section view of the wall of FIG. 7 taken along the line 8—8 in FIG. 7.

Bales 14 in each row are alternately laid between or impaled on rods 20. Trusses 17 act as horizontal beams to accommodate wind and earthquake loads and the rod column bracing requirements. In one version of this embodiment, trusses 17 include struts 22 and a pair of trussing members 18 operatively connected to bales 14. Trussing members 18 form the chords of trusses 17 and bales 14 with struts 22 form the web of trusses 17. Trussing members 18 are installed in pairs at the outside faces of bales 14 along the horizontal interfaces 26 between bales 14. Nuts 34*a* or other suitable positioning devices are installed on rods 20 along horizontal interfaces 26 between bales 14 to properly locate trusses 17. Nuts 34*b* or other suitable locking devices are then installed on rods 20. Horizontal trusses 17 span each section of wall 10 defined by any two consecutive vertical bracing elements, such as intersecting walls and vertical framing at doors and windows. The interactive connection between trussing members 18 and bales 14 is supplied by tooth like projections 18*a* on trussing members 18. One presently preferred configuration of projections 18*a* is shown in detail in FIG. 5. Projections 18*a* provide a mechanism for transferring shear forces between trussing members 18 and bales 14. Other suitable shear force transfer mechanisms could be used. For example, a series of studs 18*b* rigidly attached to the trussing members as shown in FIG. 6. What is important is that the connection be operative to transfer shear forces between the trussing members 18 and the bales 14. The interactive connection between bales 14 and the compression trussing members 18 performs a radial bracing function in a plane perpendicular to the long axis of the trussing member 18 along its entire length by mobilizing the shear resistance of bales 14. The continuous bracing of trussing member 18 allows light gauge material to be used in the manufacture of trussing members 18. The toothed projections on trussing members 18 also transfer bale shear across horizontal bale interfaces causing the stacked bales to act as a continuous diaphragm which performs the required rod bracing function in the plane of the wall. This bale diaphragm can be augmented by sheeting materials installed on either or both faces of the wall.

In an alternative version of this embodiment, trusses 17 are formed through the interconnection of trussing members 18, struts 22 and web ties 24. Struts 22 and web ties 24 form the web of trusses 17. In this version, bales 14 may function only as in-fill material or, as is more desirable, the operative connection described above between trussing members 18 and bales 14 is made to utilize the shear capacity of bales 14 to help stabilize rods 20.

The principal strategy of bearing wall system 10 is to create structurally stable bale layer interfaces and provide a longitudinal shear transfer between bale layers. The vertical rod columns 20 are then locked to these stable planes by passing through a hole in struts 22 to form viable compressive load carrying elements for gravity loads imposed on the wall.

Wall 10 is constructed with the placement of successive layers of bales and the corresponding installation of the components of skeletal framework 16. Segments 20*a* of rod columns 20 are joined together with coupling nuts 20*b* or another suitable coupling device. Alignment of the wall can be automatically achieved by assembling the trusses from pre-punched or drilled factory components. At the upper face of the top layer of bales, a header 28 is installed on and supported by nuts 30. Preferably, bearing washers 32 are sandwiched between header 28 and nuts 30. Vertical compressive loads placed on header 28 are transferred to rods 20 through bearing washers 32 and nuts 30. Preferably, nuts 35 are installed on the tops of rods 20 to holder header 28 in place.

Utilizing trusses 17, comparatively small diameter rods 20 effectively become columns capable of carrying the vertical stresses generated by live and dead gravity loads and wind and seismic loads. Rods 20 become a series of short stacked columns, each with an effective length equal to the nominal bale depth, typically about sixteen inches. This means that a six bale layer/eight foot high wall has the same load capacity as a one bale layer/sixteen inch high wall. The resulting rod column carries all of the vertical stress on the wall. The load path for bearing and uplift is directly to and from foundation 12 through rods 20. The bearing strength of wall 10 per bale length is the compressive strength of each segment 20*a* of rods 20. The uplift capacity per bale length is the lesser of either the tensile strength of rods 20 or the dead load supported by rods 20 plus one bale length's weight of attached foundation and associated structure. This means that in a tornado or hurricane, the floors, walls and roof would not be vulnerable to separation from the building without either lifting the entire building including the foundation or failing the rods 20 in tension. Wall 10 has excellent thermal and sound insulation, transfers load without excessive distortion and resists uplift to a maximum level. In addition, vertical rods 20 facilitate excellent planer alignment of the wall. Since all wall components are operatively connected to rods 20, the alignment of the wall is defined by the alignment of the rods. Trusses 17, beside bracing rods 20, provide the bending strength required to resist lateral loads generated by wind or earthquake. Horizontal trussing members 18 function as wall girts to facilitate the application of conventional interior and exterior wall treatments, including dry wall, plywood, steel, stucco and the like.

The construction "recipe" for wall 10 may be varied to produce required levels of bearing and shear load capacity or to accommodate the attachment of different wall surfaces. For example, trussing members 18 and struts 22 may be omitted at some bale interfaces in areas of excess bearing capacity. In addition, the size and shape of the various components of skeletal framework 16 may be varied as necessary to achieve the levels of bearing and shear load capacity. In-plane lateral bracing for wall 10, when not sufficiently supplied by bale shear resistance or sheeting shear resistance, may be supplied by diagonal cable type members (not shown) extending from header 28 to foundation 12 at any break in the linear continuity of the wall, such as occurs at a corner. The rod 20 at the corner then becomes the compressive member for this diagonal cable type bracing system.

Figure 9:
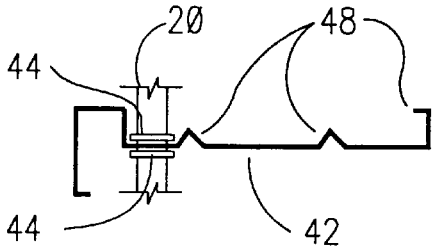
FIG. 9 is a detail view of the beam/rod connection of the wall shown in FIG. 8.
Figure 10:
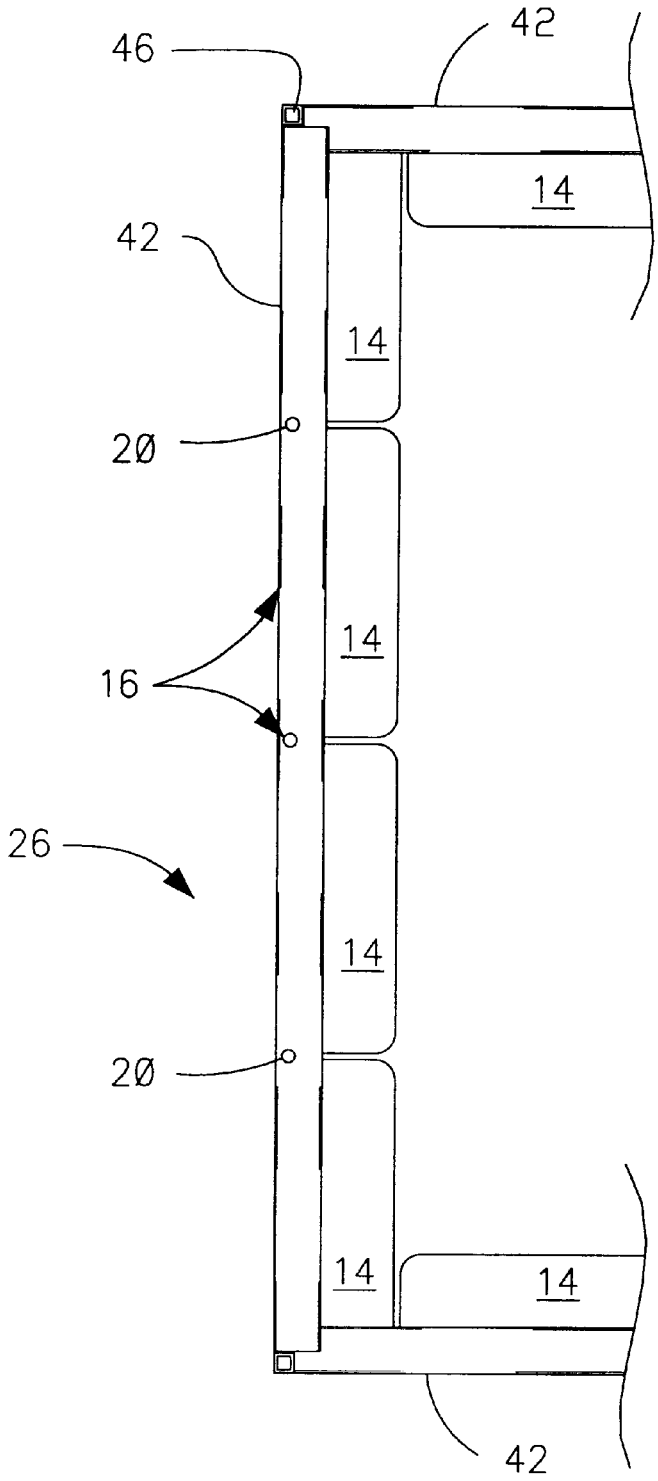
FIG. 10 is a cross section view of the wall FIG. 7 taken along the line 10—10 in FIG. 7.

In a second embodiment of the invention shown in FIGS. 7–10, skeletal framework 16 includes a series of horizontal beams 42 and vertical rods 20. In this embodiment, wall 10 is assembled by stacking bales 14 lengthwise in the non-staggered stack bond configuration. Rods 20 are continuous, not segmented. Although running bond with segmented rods may be used, stack bond is preferred in this embodiment for ease of assembly. Bales 14 in each row are laid between rods 20. Horizontal beams 42 act to resist wind loads and the lateral loads required to stabilize the rod columns. Beams 42 span each section of wall 10 defined by any two vertical bracing elements, such as corner beam/strut 46, intermediate intersecting walls and/or vertical framing at doors or windows. Preferably, beams 42 are operatively connected to bales 14 by sandwiching one beam flange in the bale interface or through some other shear transfer mechanism to utilize the shear capacity of bales 14 to help stabilize rods 20. The operative connection between bales 14 and beams 42 is through a sandwiching action on protruding elements 48 of the beam 42 at bale interface 26, as best seen in FIG. 9. Protruding elements 48 provide a mechanism for transferring shear forces between beam 42 and bales 14. A pair of snap rings 44 lock the beams 42 to rods 20 at bale interfaces 26.

The principal strategy of wall system 10 is to attain a constructed wall wherein rods 20 are locked into a fixed and stable position so that, when vertical compressive loads are imposed on rods 20, the loads are transferred directly down the rods. Wall 10 is constructed with the placement of successive layers of bales and the corresponding installation of the components of skeletal framework 16. Wall alignment is controlled by maintaining the vertical standing beam termination elements in a plumb condition through the construction process. As in the first embodiment, a header 28 is installed on and supported by nuts 30 the upper face of the top layer of bales. Bearing washers 32 are sandwiched between header 28 and nuts 30. Vertical compressive loads placed on header 28 are transferred to rods 20 through bearing washers 32 and nuts 30.

Utilizing beams 42 as described, comparatively small diameter rods 20 effectively become columns capable of carrying the vertical stresses generated by live and dead gravity loads and wind and seismic loads. As in the first embodiment, rods 20 become a series of short stacked columns, each with an effective length equal to the nominal bale depth, typically about sixteen inches. This means that a six bale layer/eight foot high wall has the same load capacity as a one bale layer/sixteen inch high wall. The resulting rod column carries all of the vertical stress on the wall. The load path for bearing and uplift is directly to and from foundation 12 through rods 20. The bearing strength of wall 10 per bale length is the compressive strength of each bale length segment of rods 20. The uplift capacity per bale length is the lesser of either the tensile strength of rods 20 or the dead load supported by rods 20 plus one bale length's weight of attached foundation and associated structure. Beams 42, beside bracing rods 20, provide the bending strength required to resist lateral loads generated by wind or earthquake. Horizontal beams 42 function as wall girts to facilitate the application of conventional interior and exterior wall treatments, including dry wall, plywood, steel, stucco and the like.

In-plane lateral bracing for wall 10, when not sufficiently supplied by bale shear resistance or sheeting shear resistance, may be supplied by diagonal cable or rod type members (not shown) extending from header 28 to foundation 12 at any break in the linear continuity of the wall, such as occurs at a corner. The corner beam/strut 46 at the corner then becomes the compressive member for this diagonal rod type bracing system.

The preferred sizes and cross sectional configurations of the various components of skeletal framework 16 are listed below for a typical building application using steel components.

| Part and Part No. | Material | Cross Section | Length |
|---|---|---|---|
| Rods 20 | Threaded stock | Round, ¾" dia. | 3'–9' |
| Struts 22 | Square tubing | 1½" × 1½" × 18 ga. | 2' |
| Trussing members 18 | Sheet stock angle with formed projections | 4½" × 1½" × 20 ga. | 8'–12' |
| Header 28 | Square tubing | 3" × 14 ga. | 20' |
| Web ties 24 | Flat sheet stock | 2" × 20 ga. | As Required |
| Auxiliary framing 40 | Miscellaneous sheet stock Cees, Zees and Angles to facilitate sheeting attachment and framework bracing | L -- 1½" × 1½" × 20 ga.<br>C -- 3½" × 1½" × 20 ga.<br>Z -- 3½" × 1½" × 20 ga. | As Required |
| Beams 42 | Roll formed section | 14–18 ga. | As Required |

It is to be understood that the invention is not limited to the embodiments shown and described above. Various other embodiments of the invention may be made and practiced without departing from the scope of the invention, as defined in the following claims.

What is claimed is:

1. In a wall system having a plurality of quasi-structural building blocks stacked in a vertical plane within a skeletal framework, the skeletal framework comprising:

a plurality of trusses at horizontal interfaces between blocks; and a plurality of rods operatively connected to the trusses, the rods oriented vertically and positioned along the blocks.

2. The skeletal framework of claim 1, wherein the rods are positioned along a center line of the blocks.

3. The skeletal framework of claim 1, further comprising a header connected across a top end of the rods.

4. The skeletal framework of claim 1, further comprising a foundation anchoring a bottom end of the rods.

5. The skeletal framework of claim 1, wherein each truss comprises a pair of trussing members operatively connected to blocks and positioned opposite one another along an interface between blocks.

6. The skeletal framework of claim 5, wherein each truss further comprises a plurality of struts extending between the trussing members at substantially right angles.

7. The skeletal framework of claim 6, wherein each truss further comprises plurality of web ties extending diagonally between trussing members.

8. The skeletal framework of claim 1, wherein each truss comprises a plurality of struts extending between the trussing members at substantially right angles and a plurality of web ties extending diagonally between trussing members.

9. In a wall system having a plurality of quasi-structural building blocks stacked in a vertical plane within a skeletal framework, the skeletal framework comprising:

a plurality of trussing members arranged in pairs, each trussing member having projections thereon to penetrate the blocks;

plurality of struts extending between the trussing members at substantially right angles; and a plurality of rods operatively connected to the struts, the rods oriented vertically and positioned along the blocks.

10. The skeletal framework of claim 9, wherein each strut has a hole therein and the rods pass through the holes in the struts to form the operative connection between the rods and the struts.

11. The skeletal framework of claim 9, further comprising a plurality of web ties extending diagonally between trussing members.

12. In a wall system having a plurality of quasi-structural building blocks stacked in a vertical plane within a skeletal framework, the skeletal framework comprising:

a plurality of beams at horizontal interfaces between blocks; and a plurality of rods operatively connected to the beams, the rods oriented vertically and positioned along the blocks.

13. The skeletal framework of claim 12, wherein the rods are positioned along side the blocks.

14. The skeletal framework of claim 13, wherein the beams are positioned along an edge of the blocks.

15. The skeletal framework of claim 12, wherein the rods are positioned along a center line of the blocks.

16. The skeletal framework of claim 15, wherein the beams are positioned along a centerline of the blocks.

17. The skeletal framework of claim 12, wherein the beams are operatively connected to blocks.

18. The skeletal framework of claim 17, wherein the beams have elements protruding therefrom to penetrate blocks.

19. A wall system, comprising:

a plurality of quasi-structural building blocks stacked in a vertical plane;

a plurality of trusses at horizontal interfaces between blocks; and a plurality of rods operatively connected to the trusses, the rods oriented vertically and positioned along the blocks.

20. The wall system of claim 19, wherein the rods are positioned along a center line of the blocks.

21. The wall system of claim 19, further comprising a header connected across a top end of the rods.

22. The wall system of claim 19, further comprising a foundation anchoring a bottom end of the rods.

23. The wall system of claim 19, wherein each truss comprises a pair of trussing members operatively connected to the blocks and positioned opposite one another along an interface between blocks.

24. The wall system of claim 23, wherein each truss further comprises a plurality of struts extending between the trussing members at substantially right angles.

25. The wall system of claim 24, wherein each truss further comprises a plurality of web ties extending diagonally between trussing members.

26. The wall system of claim 19, wherein each truss comprises a plurality of struts extending between the trussing members at substantially right angles and a plurality of web ties extending diagonally between trussing members.

27. The wall system of claim 19, wherein the quasi-structural building blocks are fiber bales.

28. A wall system, comprising:

a plurality of quasi-structural building blocks stacked in a vertical plane;

a plurality of trussing members arranged in pairs, each trussing member having projections thereon to penetrate the blocks;

plurality of struts extending between the trussing members at substantially right angles; and a plurality of rods operatively connected to the struts, the rods oriented vertically and positioned along the blocks.

29. The wall system of claim 28, wherein each strut has a hole therein and the rods pass through the holes in the struts to form the operative connection between the rods and the struts.

30. The wall system of claim 29, further comprising a plurality of web ties extending diagonally between trussing members.

31. The wall system of claim 28, wherein the quasi-structural building blocks are fiber bales.

32. A wall system, comprising:

a plurality of quasi-structural building blocks stacked in a vertical plane;

a plurality of beams at horizontal interfaces between blocks; and a plurality of rods operatively connected to the beams, the rods oriented vertically and positioned along the blocks.

33. The wall system of claim 32, wherein the rods are positioned along side the blocks.

34. The wall system of claim 32 wherein the rods are positioned along a center line of the blocks.

35. The wall system of claim 32, wherein the beams have elements protruding therefrom to penetrate the blocks.

36. The wall system of claim 33, wherein the beams are positioned along an edge of the blocks.

37. The wall system of claim 34, wherein the beams are positioned along a centerline of the blocks.

38. The wall system of claim 32, wherein the quasi-structural building blocks are fiber bales.

39. A wall system, comprising a plurality of rod columns integrated into a matrix of quasi-structural building blocks.

40. A wall system according to claim 39, wherein each rod column comprises a radially braced rod.

41. A wall system according to claim 40, further comprising a bracing beam operatively connected to the rods.

42. A wall system according to claim 40, further comprising a bracing truss operatively connected to the rods.

43. A wall system, comprising a plurality of rod columns operatively connected to a plurality of quasi-structural building blocks arranged in horizontal layers stacked in a vertical plane.

44. A wall system according to claim 43, wherein each rod column comprises a vertically oriented rod radially braced by the building blocks.

45. A wall system according to claim 44, further comprising a bracing beam operatively connected between the building blocks and the rods.

46. A wall system according to claim 44, further comprising a bracing truss operatively connected between the building blocks and the rods.

* * * * *